US010537774B1

(12) United States Patent
Burch

(10) Patent No.: US 10,537,774 B1
(45) Date of Patent: Jan. 21, 2020

(54) PUTTING CUP SYSTEM

(71) Applicant: Thomas B. Burch, Banner Elk, NC (US)

(72) Inventor: Thomas B. Burch, Banner Elk, NC (US)

( * ) Notice: Subject to any disclaimer, the term of this patent is extended or adjusted under 35 U.S.C. 154(b) by 0 days.

(21) Appl. No.: 16/401,925

(22) Filed: May 2, 2019

(51) Int. Cl.
*F21V 21/00* (2006.01)
*A63B 57/40* (2015.01)

(52) U.S. Cl.
CPC ..... *A63B 57/40* (2015.10); *A63B 2207/02* (2013.01)

(58) Field of Classification Search
CPC ..... A63B 57/40; A63B 2207/02
USPC ..... 362/234
See application file for complete search history.

(56) References Cited

U.S. PATENT DOCUMENTS 5,478,076 A 12/1995 Desjardins
7,594,859 B2 9/2009 Mullen
8,465,377 B1 * 6/2013 Kamnikar ..... A63B 69/3676 473/266
8,753,218 B2 6/2014 Suchanek
8,864,333 B2 10/2014 Burkart et al.
9,108,097 B1 * 8/2015 Rhone ..... A63B 69/3676
9,415,283 B2 * 8/2016 Skurow ..... A63B 57/0056
2009/0197691 A1 * 8/2009 Mullen ..... A63B 57/357 473/176
2009/0206759 A1 8/2009 Wang et al.
2010/0004068 A1 * 1/2010 Adame ..... A63B 57/357 473/176
2010/0160057 A1 * 6/2010 Willett ..... A63B 57/357 473/176
2011/0201437 A1 8/2011 Fallow et al.
2013/0210534 A1 * 8/2013 Suchanek ..... A63B 69/3691 473/150
2013/0314906 A1 * 11/2013 Spinner ..... F21V 33/008 362/145
2014/0185278 A1 * 7/2014 Burkart ..... F21V 33/008 362/183
2016/0252243 A1 * 9/2016 Garcia ..... F21V 33/008 362/362

(Continued)

OTHER PUBLICATIONS

Night Sports, Backyard LED Night Golf Pitch & Putt, Internet, Aug. 4, 2015, 5 pages.

*Primary Examiner* — Laura K Tso
(74) *Attorney, Agent, or Firm* — Christopher C. Dremann, P.C.; Christopher C. Dremann

(57) ABSTRACT

A putting cup includes an exterior housing configured to be disposed within a putting hole on a putting green and an interior core configured to be inserted into and attached to the exterior housing while the exterior housing is disposed within the putting hole. At least a portion of the interior core is at least partially translucent and defines an interior compartment for housing electronic components for illuminating the interior core. The electronic components include at least one battery electrically coupled to a printed circuit board, at least one light-emitting diode electrically coupled to the PCB and a dimmer circuit for periodically interrupting electrical power to the at least one LED to extend the battery life. A custom tool attaches the interior core to the exterior housing and detaches the interior core from the exterior housing while the exterior housing is disposed within the putting hole on the putting green.

20 Claims, 7 Drawing Sheets

(56) References Cited

U.S. PATENT DOCUMENTS

| | | | | |
|---|---|---|---|---|
| 2017/0014694 | A1* | 1/2017 | Skurow | A63B 57/405 |
| 2017/0050095 | A1 | 2/2017 | Burch | |

* cited by examiner

PUTTING CUP SYSTEM

FIELD OF THE INVENTION

The present invention relates to a system for putting sports and games. More particularly, the invention is a putting cup system for putting sports and games, such as traditional golf, executive golf, miniature golf and the like.

BACKGROUND OF THE INVENTION

Sports and games that involve propelling a ball at a target or into a receptacle are well known. For example, the traditional sport and game of golf involves striking a golf ball with a variety of different golf clubs from a tee area onto a putting green, and then putting the golf ball into a putting hole. For consistency, a cylindrical receptacle, referred to herein as a "putting cup," is positioned within the putting hole to receive the golf ball. Most putting cups adhere to standardized dimensions, including the diameter and the depth of the putting cup. In many instances, the putting cup is also recessed a standard depth below the putting surface of the putting green. For example, United States Golf Association (USGA) Rules of Golf require that a putting hole in a putting green should be 4 and ½ inches in diameter and the putting cup must be sunk at least 1 inch below the putting surface of the putting green. Consequently, putting cups typically consist of a thin-walled cylinder made of stiff plastic or aluminum material having an outer diameter of about 4 and ¼ inches, an inner diameter of about 4 and 1/16 inches, and a depth between about 4 inches and about 6 inches. The top of the putting cup is open and the bottom of the putting cup is generally angled downward and inward conically towards the center. One or more openings may be formed in the bottom of the putting cup for drainage and/or an opening may be provided at the center of the bottom of the putting cup to receive a flagstick or similar marker.

Typically, miniature golf games utilize the same style and type of putting cup as the traditional golf game. Generally speaking, the putting cup for miniature golf games is a round cylinder having an inner diameter of about 4 and ¼ inches and a depth of at least about 4 inches. The putting cup of a miniature golf game may be made of a relatively lightweight, yet sturdy material, such as metal (e.g. aluminum), plastic or composite. A putting hole is formed in the putting surface of an artificial putting green and the putting cup is disposed within the putting hole. In most instances, the center of the putting cup is indicated by a pole or similar marker, commonly referred to as a flagstick, extending upward from the putting surface of the putting green. However, like the traditional golf game, the flagstick indicates the location of the putting hole only when it is present and upright in the putting cup. A player often removes the flagstick to putt the putting ball into the putting cup and sometimes accidently fails to replace the flagstick in the putting cup. Alternatively, vandals may maliciously remove the flagstick and intentionally not replace the flagstick into the putting cup. Furthermore, repeated removal of the flagstick from the putting cup can damage the putting surface of the putting green. Regardless, a conventional flagstick or similar marker is not adequate for locating the putting hole in poor or reduced ambient light conditions, such as rain, fog and darkness.

It is therefore apparent a need exists for a putting cup system for a putting sport or game that overcomes the aforementioned problems and deficiencies. A particular need exists for a putting cup system that indicates the location of a putting hole on a putting green without the presence of a flagstick or similar marker. A further particular need exists for a putting cup system that indicates the location of a putting hole on a putting green even in poor, reduced, low or no ambient light conditions, for example rain, fog and darkness. Such a putting cup system should be suitable for use in traditional golf and miniature golf, as well as other putting sports and games. Furthermore, such a putting cup system should meet the USGA standardized requirements for a golf putting cup and should not alter or interfere with the purpose or function of a conventional putting cup of the type utilized for traditional golf, executive golf or miniature golf.

Certain aspects, objects, features and advantages of the present invention will be made apparent, or will be readily understood and appreciated by those skilled in the relevant art, with reference to exemplary embodiments of the invention shown in the accompanying drawing figures are described herein. It is expressly intended that all such aspects, objects, features and advantages of the invention embodied by the exemplary embodiments set forth herein be encompassed within the scope of protection of the appended claims given their broadest reasonable interpretation and construction in view of this disclosure and the relevant prior art. These aspects, objects, features and advantages of the invention, as well as others not expressly or inherently disclosed, may be accomplished by any of the exemplary embodiments shown in the drawing figures and described herein. However, it should be appreciated that the drawing figures are for illustrative purposes only, and that many modifications, revisions or substitutions may be made to any of the exemplary embodiments without departing from the general concepts of the invention as they may be broadly interpreted and construed.

BRIEF DESCRIPTION OF THE DRAWINGS

The aforementioned aspects, objects, features and advantages of the present invention will be more fully understood and appreciated when considered with reference to the accompanying drawing figures, in which like reference characters designate the same or similar parts throughout the several views.

DETAILED DESCRIPTION OF EXEMPLARY EMBODIMENTS OF THE INVENTION

Figure 1:
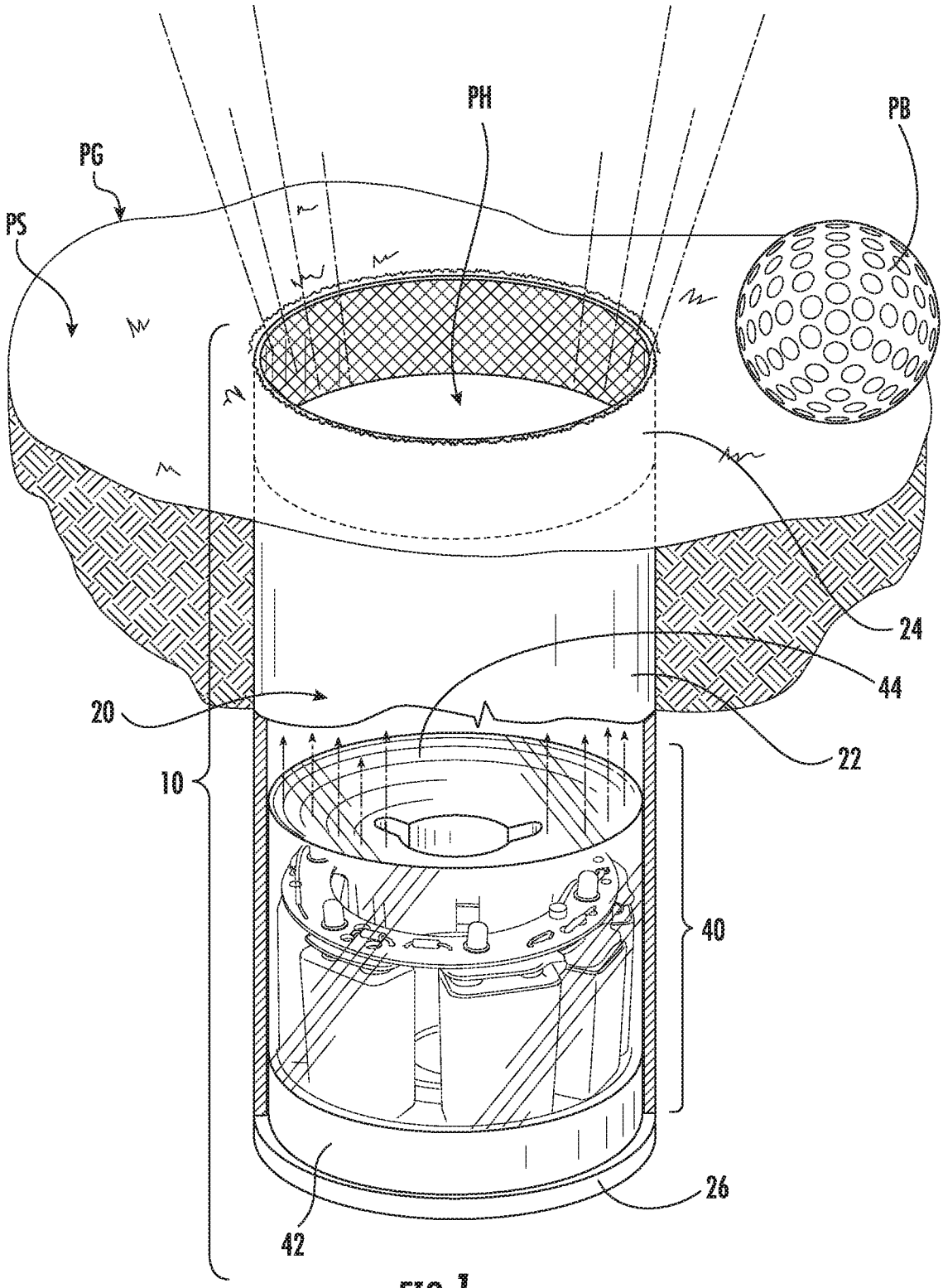
FIG. 1 is an environmental perspective view of an exemplary embodiment of a putting cup system according to the present invention with a portion of an exterior housing of the putting cup system broken away to show an interior core of the putting cup system.

The following is a detailed description of exemplary embodiments of a putting cup system for putting sports and putting entertainment games. Exemplary embodiments of a putting cup system for putting games are described more fully hereinafter with reference to the accompanying drawing figures. In the exemplary embodiments shown and described herein, a putting cup system, also referred to herein as a "putting cup" and indicated generally by reference character 10, is useful for indicating the location of a putting hole PH on a putting green PG of a putting sport or game and/or for differentiating between different putting holes PH on a putting green PG of a putting sport or game without the presence of a flagstick or similar marker. The putting cup system 10 may be utilized at any time a putting sport or game is being played, but is particularly advantageous when a putting sport or game is being played in poor, reduced, low or no ambient light conditions, such as rain, fog or darkness.

In a particularly advantageous embodiment, the putting cup 10 is useful for indicating the location of a putting hole PH on a putting green PG having multiple putting holes PH and for differentiating between the different putting holes PH on the putting green PG of a putting sport and game commercially known as "HiLo." The HiLo putting sport and game is so named due to its unique combination of strategy and skill for playing and scoring. The HiLo putting sport and game combines the strategy of high points scoring with the skill of a low number of putting stokes. HiLo is designed to be a less time consuming, more affordable and practical alternative to traditional golf and executive golf, while at the same time providing more strategy and challenge than miniature golf to persons having various levels of experience, skill and ability. The HiLo putting sport and game involves a unique scoring system that allows players to select a level of difficulty of a particular putting hole PH, and thereby determine a strategy for maximizing a player score based on the putting ability of the player. In this manner, players having different levels of skill, experience and ability are able to compete with one another on the same course without an advantage based on age or strength.

Each putting green PG in the HiLo putting sport and game provides a player with the choice of a plurality of putting cups 10 positioned at different locations on the putting green PG with each putting cup 10 having a different scoring value. The player score for each round, referred to as a "hole," of the HiLo putting sport and game depends on the number of putting strokes the player makes to putt a putting ball PB into a putting cup 10 and the scoring value of the putting cup 10. For example, if the scoring value of the putting cup 10 is 10 points and the player makes 2 putting strokes to putt the putting ball PB into the putting cup 10, the player has made a "par" and is awarded the total scoring value of the putting cup 10, which in this example results in a player score of 10 points. Alternatively, if the player makes 3 putting strokes to putt the putting ball PB into the putting cup 10, in this case a "bogey," the player is awarded the scoring value divided by 2, which in this example results in a player score of 5 points. Alternatively, if the player makes only 1 putting stroke, in this case a "hole-in-one" or a "birdie," the player is awarded the scoring value multiplied by 2, which in this example results in a player score of 20 points. If the player makes 4 putting strokes or putts the putting ball PB off the putting green PG, the player receives no points, which results in a player score of 0 points for that hole of the HiLo putting sport and game.

In one embodiment, the plurality of putting cups 10 are designated by different colors. In particular, each of the putting cups 10 is designated by a different color. In a further embodiment, each of the putting cups 10 is illuminated by a light source having a different color. In a particularly advantageous embodiment, there are 5 putting cups 10 on each putting green PG of each hole of the HiLo putting sport and game. The 5 putting cups 10 are illuminated by a white, a green, a blue, a red and a gold color light source with a corresponding "par" scoring value of 2, 4, 6, 8 and 10 points, respectively. The putting sport and game commercially known as "HiLo" is more fully described in United States Patent Application Publication No. 2017/0050095 A1 published on Feb. 23, 2017, and filed in the name of the inventor of the present application.

FIG. 1 shows an exemplary embodiment of a putting cup system 10 constructed in accordance with the present invention. FIG. 1 is a perspective view of the putting cup system 10 with a portion of an exterior housing, indicated generally by reference character 20, broken away to show an interior core, indicated generally by reference character 40. The putting cup 10 is disposed within a putting hole PH formed in a putting green PG. The putting green PG for example may be a putting green of a hole of a traditional golf game or executive style golf game. Alternatively, the putting green PG may be a putting green of a hole of a miniature golf game. For purposes of the present disclosure, the putting green PG is a putting green of a hole of the HiLo putting sport and game discussed hereinabove and described in greater detail in United States Patent Application Publication No. 2017/0050095 A1. The exterior housing 20 may be disposed directly within a putting hole PH formed in a putting green PG having a natural grass putting surface PS suitable for putting a putting ball PB. Alternatively, the exterior housing 20 may be disposed within an outer receptacle (not shown) having an inner diameter sized to receive the exterior housing 20 that is recessed into a putting green PG having an artificial grass putting surface PS suitable for putting a putting ball PB. In either instance, the putting cup 10 may be removed from the putting hole PH or from the outer receptacle as necessary and replaced with a different putting cup 10, or moved to another location on the putting green PG. Preferably, however, the interior core 40 is removably disposed within the exterior housing 20 and only the interior core 40 is removed and replaced, as will be described in greater detail hereafter.

Figure 2:
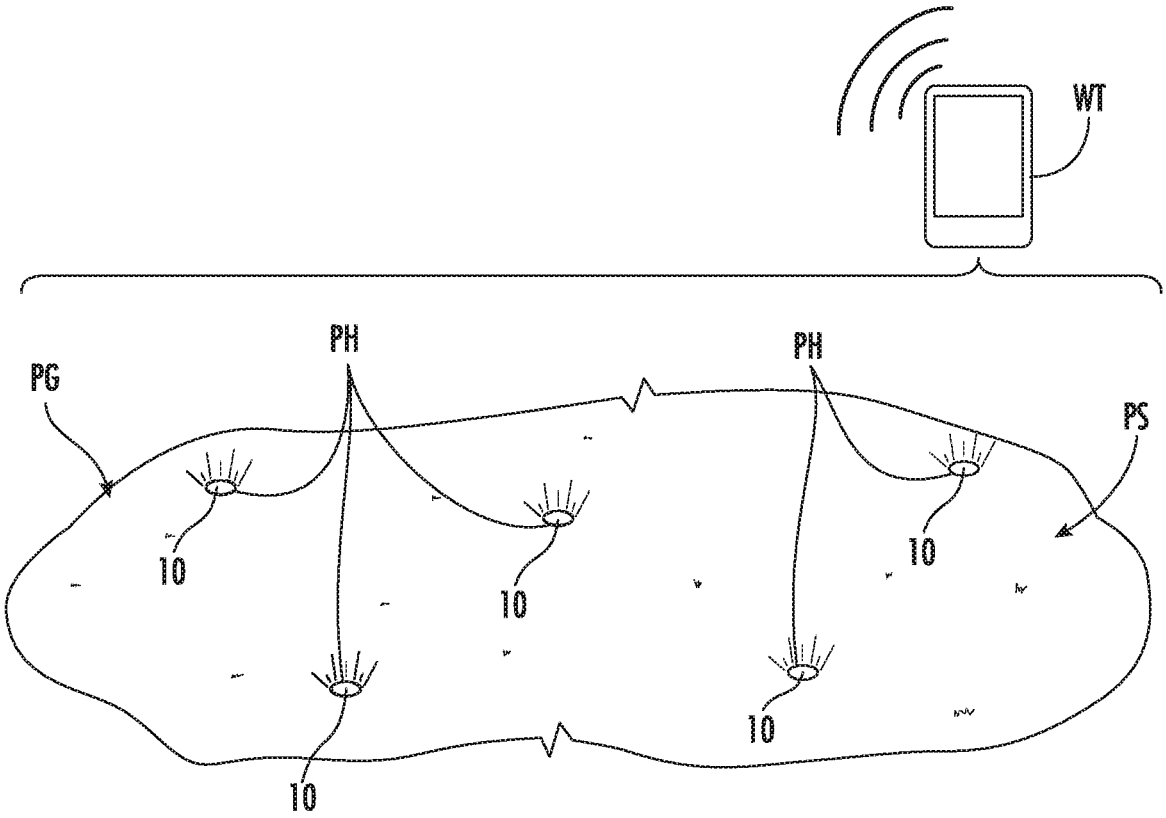
FIG. 2 is an environmental perspective view illustrating a plurality of putting holes formed in a putting surface of a putting green with a putting cup system according to FIG. 1 disposed within each of the putting holes.

FIG. 2 is a perspective view illustrating a plurality of putting holes PH formed in a putting surface PS of a putting green PG with a putting cup system 10 according to the present invention disposed within each of the putting holes PH. The putting green PG for example may be a practice putting green of the type made available at most traditional and executive golf courses. Alternatively, the putting green PG may be a putting green of a hole of the HiLo putting sport and game discussed hereinabove and described in greater detail in United States Patent Application Publication No. 2017/0050095 A1. As illustrated in FIG. 2, each of the putting cups 10 is illuminated by a light source. In the case that the putting green PG is a putting green of a hole of the HiLo putting sport and game, each of the putting cups 10 is illuminated by a light source having a different color. As described hereinabove, the 5 putting cups 10 are preferably illuminated by a white, a green, a blue, a red and a gold light source. If desired, the illumination of the putting cups 10, for example the activation (on-off), the intensity (brightness) and/or the duration (timing) of the illumination, may be controlled wirelessly using a wireless transmitter WT, such as a Radio Frequency (RF), Bluetooth or Near Field Communication (NFC) transmitter, in a known manner. In one embodiment, the wireless transmitter WT is a Smartphone having a mobile application for wireless communication with a wireless transceiver provided within each putting cup system 10. The mobile application may also acquire data from the wireless transceiver relating to the putting cup 10, such as identification of the interior core 40 and its remaining battery life.

Figure 3:
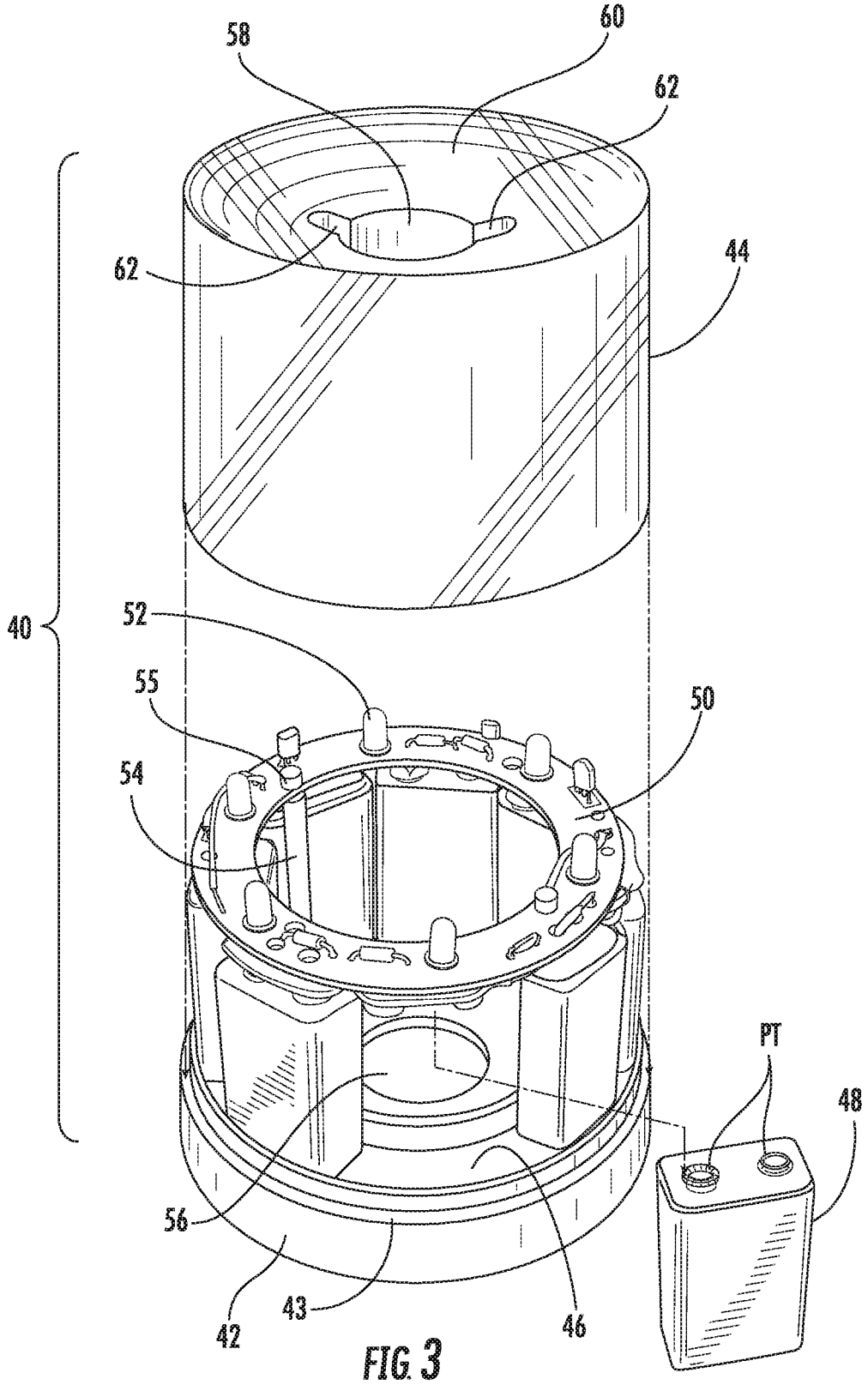
FIG. 3 is an exploded perspective view showing the interior core of the putting cup system of FIG. 1.

FIG. 3 is an exploded perspective view showing the interior core 40 of the putting cup system 10 of FIG. 1. As shown, the interior core 40 comprises an annular base 42 and a cylindrical cover 44 that is secured onto the base 42. The base 42 and the cover 44 are each made of a relatively lightweight, yet sturdy, material that is sufficiently rigid and resistant to adverse environmental conditions, such as moisture, salt air and airborne chemicals. For example, the base 42 and the cover 44 may be made of a rigid plastic material, such as a thermoplastic material. The base 42 may be made of an opaque plastic material. The cover 44, however, is made of a plastic material that is at least translucent. Preferably, the cover 44 is made of a plastic material that is essentially transparent, and more preferably, is made of a transparent thermoplastic polymer, such as polycarbonate, PMMA (Acrylic), clear polyethylene terephthalate (PET) or clear polyvinyl chloride (PVC).

By way of example and not limitation, the base 42 and the cover 44 may be secured by an interference fit, such that simultaneously pressing and turning (rotating) the cover 44 relative to the base 42 secures the cover 44 onto the base 42. Similarly, simultaneously lifting and turning (rotating) the cover 44 relative to the base 42 removes the cover 44 from the base 42. Alternatively, an annular O-ring (not shown) made of a generally resilient material, such as rubber or soft plastic, may be disposed on an outer circumferential periphery 43 of the base 42 so as to provide a watertight seal between an inner wall of the cover 44 and the periphery 43 of the base 42. Conversely, an annular O-ring (not shown) made of a generally resilient material, such as rubber of soft plastic, may be disposed within a groove (not shown) formed in the inner wall of the cover 44 so as to provide a watertight seal between the periphery 43 of the base 42 and the inner wall of the cover 44. Alternatively, the cover 44 may be permanently secured onto the base 42 for example by plastic weld, fusion, or adhesive glue suitable for adhering plastic materials to one another.

Regardless, the base 42 defines an upper surface 46 configured to support a plurality of batteries 48 for providing electrical power to electronics in the form of a printed circuit board (PCB) 50 positioned above the batteries 48. In one embodiment, each of the batteries 48 is a 9 volt battery. As shown herein, the PCB 50 is annular, and more particularly, is ring-shaped. PCB 50 comprises a power supply circuit and a processor circuit in a known manner. The PCB 50 further comprises a plurality of internal light sources in the form of light-emitting-diodes (LEDs) 52 electrically coupled to the power supply and the processor circuit. In one embodiment, the LEDs 52 are spaced circumferentially around an upper surface of the ring-shaped PCB 50. When the power supply circuit of PCB 50 is activated, the processor circuit directs electrical power to each of the plurality of LEDs 52 so that the LEDs provide an illuminated light source to the interior core 40. More particularly, the LEDs 52 provide an illuminated light source that projects upwardly and outwardly through the transparent cover 44 of the interior core 40. In one embodiment, the LEDs 52 project a colored light corresponding to the desired color of one of the putting holes PH on the putting green PG of the HiLo putting sport and game previously described.

The cover 44 of the interior core 40 defines a generally hollow, annular interior compartment that houses the electronic components, namely the batteries 48, the PCB 50 and the LEDs 52, of the putting cup 10. The PCB 50 may be supported with mating contacts directly on the negative and positive power terminals PT of the batteries 48. Alternatively, a plurality of stand-offs 54 may be provided that extend between the base 42 and the PCB 50. As best shown in FIG. 3, a pair of elongate stand-offs 54 embedded in the base 42 extend upwardly from the upper surface 46 of the base 42 and through the PCB 50. At least the upper ends of the stand-offs 54 are externally threaded to receive corresponding internally threaded stand-off caps 55 to position the PCB 50 above and adjacent to the power terminals PT of the batteries 48.

It has been determined that a 9 volt lithium polymer rechargeable battery manufactured by TD HiTech Energy Inc. of Hsinchu City, Taiwan and commercially available from GN Batteries & Electronics Inc. of Walnut, Calif. USA is particularly suitable for use with the interior core 40 of the putting cup 10 provide a desired intensity (brightness) of the LEDs 52 without appreciable loss over the duration of the battery life for a desired run-time of the LEDs 52 before recharging the batteries 48. It has also been determined that electrically connecting the batteries 48 in parallel increases the battery life between recharges, and consequently, the run-time of the LEDS 52. It has further been determined that the battery life of the batteries 48 may be significantly increased, for example at least doubled, by providing a circuit on the PCB 50 that repeatedly momentarily interrupts power to the LEDs 52 so that the LEDs 52 imperceptibly blink up to 50,000 times per minute.

The base 42 has a central opening 56 formed therethrough and the cover 44 has a corresponding central opening 58 formed therethrough. The openings 56, 58 are disposed inwardly and centrally of the annular array of batteries 48 and the ring-shaped PCB 50. With the cover 44 secured onto the base 42, the opening 58 of the cover 44 is aligned and in direct communication with the opening 56 of the base 42. Furthermore, the upper surface 60 of the cover 44 defines a conical-shape that slopes inwardly and downwardly from the outer circumferential periphery of the cover 44 to the central opening 58 at a standard or USGA regulation angle. Consequently, the central opening 58 in the cover 44 and the central opening 56 in the base 42 provide a drain for passing water, moisture and small debris into the ground beneath the putting cup 10 when the interior core 40 is inserted into an exterior housing 20 disposed within a putting hole PH formed in a putting surface PS of a putting green PG. The cover 44 also has one or more recesses 62 that extend outward radially from the central opening 58. The opening 58 and recesses 62 are configured to receive a custom tool 80 (see FIG. 5) for inserting the interior core 40 into the exterior housing 20 and for attaching the core 40 to the housing 20, as will be described hereafter. The opening 58 and recesses 62 may further receive and prevent rotation of an optional flagstick or similar marker removably positioned within the putting hole PH. However, as previously mentioned, the use of a flagstick or similar marker is discouraged due to the likelihood of malicious vandalism and/or damage to the putting surface PS of the putting green PG.

Figure 4:
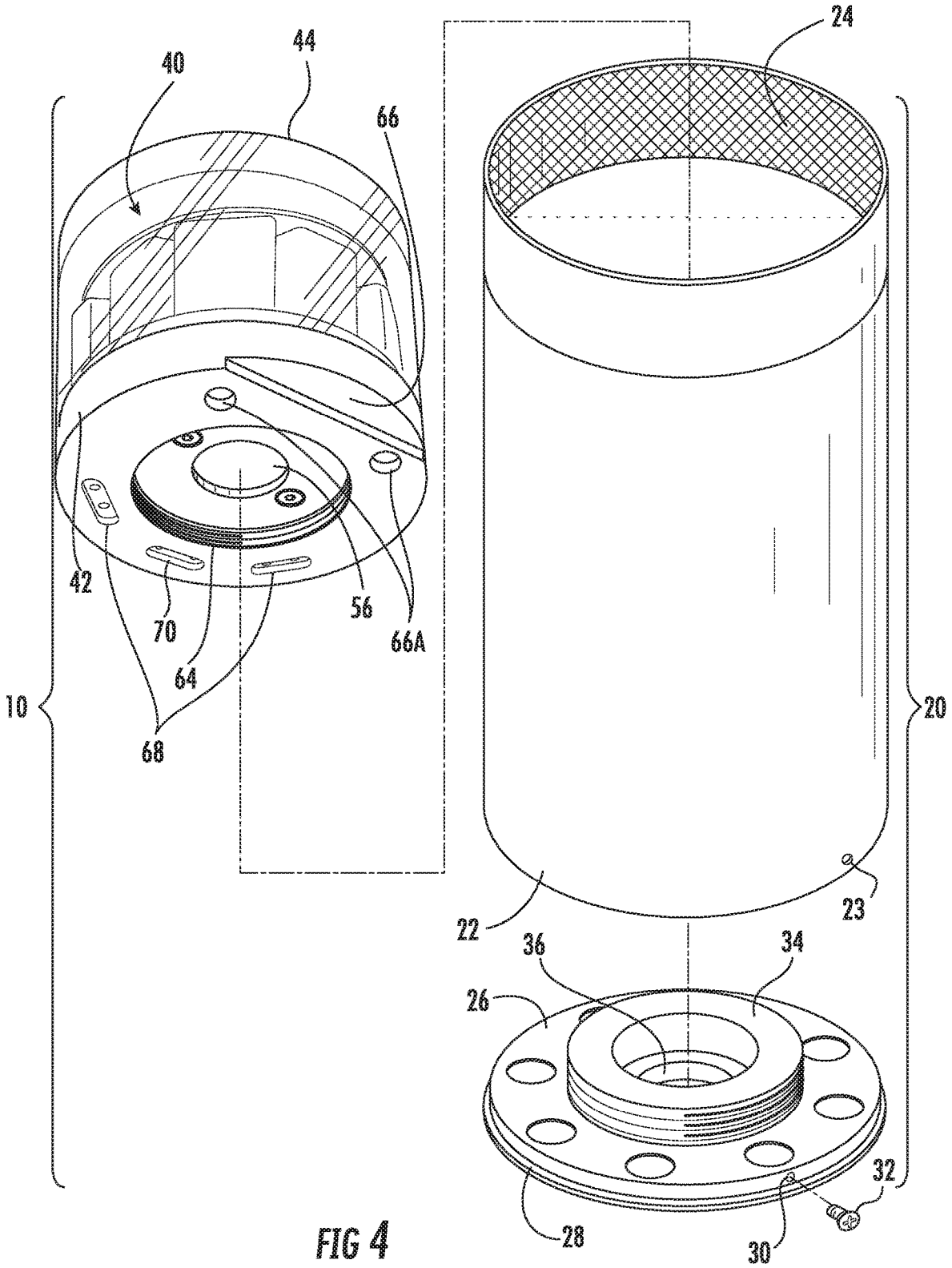
FIG. 4 is an exploded perspective view showing the assembly of the putting cup system of FIG. 1.

FIG. 4 is an exploded perspective view showing the assembly of the putting cup system 10 of FIG. 1. The exterior housing 20 comprises a thin-walled cylindrical sleeve 22, an optional thin-walled cylindrical upper ring 24, and an annular lower end cap 26. The sleeve 22 is preferably made of a lightweight yet sufficiently rigid plastic, composite or metal material, such as aluminum. The optional upper ring 24 is likewise made of a lightweight yet sufficiently rigid plastic, composite or metal material. The sleeve 22 and the upper ring 24 are each provided with a reflective inner surface. In one embodiment, the inner surface of the ring 24 is provided with a color to match the color illuminated by the LEDs 52 of the interior core 40 inserted within the exterior housing 20 of the putting cup 10. The inner surface of the ring 24 may be coated or sprayed with a luminescent, fluorescent or phosphorescent paint of the desired color. Alternatively, the inner surface of the ring 24 may be lined with a colored phosphorous vinyl tape of the type available from the 3M Company of Maplewood, Minn.

The upper ring 24 may be integrally formed with the sleeve 22 or may be permanently affixed thereto. Preferably, however, the upper ring 24 is removably attached to the sleeve 22 so that the ring 24 is interchangeable with the sleeve 22. This embodiment is particularly useful for the HiLo putting sport and game when an interior core 40 illuminating one color is removed and replaced with a core 40 illuminating another color, while the exterior housing 20 remains disposed in a putting hole PH at the same location on the putting green PG. Thus, the color of the upper ring 24 can be matched with the color illuminated by the LEDs 52 of the interior core 40 inserted into and attached to the exterior housing 20.

The lower end cap 26 may be permanently affixed to the sleeve 22 of the exterior housing 20. In the embodiment shown herein, an outer circumferential periphery 28 of the end cap 26 has a stepped recess and an internally threaded insert 30. The insert 30 extends radially inward and receives a set screw 32 within an opening 23 formed through the sleeve 22 to removably secure the end cap 26 onto the sleeve 22. The lower end cap 26 further comprises an externally threaded annular receiver 34 configured to receive an internally threaded cylindrical receiver 64 provided on the base 42 of the interior core 40. The annular receiver 34 defines a central opening 36 through the end cap 26 that is aligned and in communication with the central openings 56, 58 of the interior core 40 when the core 40 is inserted into and attached to the exterior housing 20. The internally threaded cylindrical receiver 64 provided on the base 42 of the interior core 40 is configured to engage with the externally threaded annular receiver 34 of the end cap 26 of the exterior housing 20. As illustrated in FIG. 4, the interior core 40 is inserted into the exterior housing 20 and the annular receiver 34 provided on the end cap 26 of the housing 20 is mated with the cylindrical receiver 64 provided on the base 42 of the core 40.

In the manner described herein, the interior core 40 of the putting cup 10 can be removably attached to the exterior housing 20. It is advantageous to be able to remove the interior core 40 from the exterior housing 20 without removing the housing 20 from the putting hole PH or the outer receptacle on the putting green PG for the purpose of replacing the core 40 with a core 40 having charged batteries 48 and/or interchanging the core 40 with a core 40 having LEDs 52 that illuminate a different color. A removable, replaceable and interchangeable interior core 40 is particularly useful for easily maintaining the putting cups 10 of the HiLo putting sport and game previously described. Specifically, the interior core 40 of the putting cups 10 can be readily replaced with a fully-charged or recharged core 40 and the configuration of the putting cups 10 on the putting green PG can be readily reconfigured to vary the layout of a hole of the HiLo putting sport and game.

Figure 5:
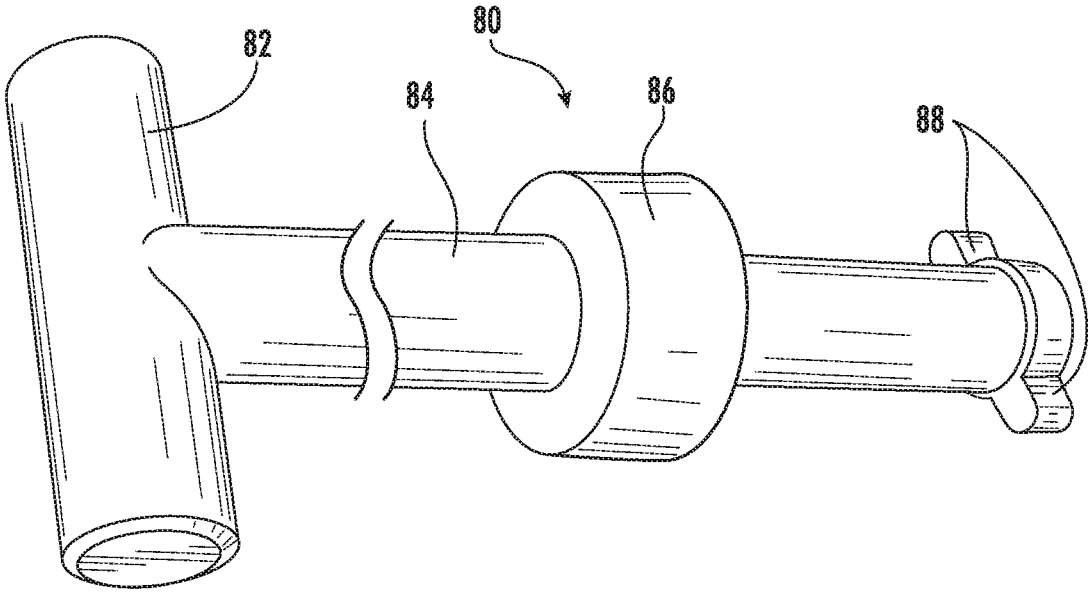
FIG. 5 is a perspective view of an exemplary embodiment of a custom tool for inserting and attaching the interior core to the exterior housing of the putting cup system of FIG. 1.

FIG. 5 is a perspective view of an exemplary embodiment of a custom tool, indicated generally by reference character 80, for inserting and attaching the interior core 40 to the exterior housing 20 of the putting cup system 10 of FIG. 1. The tool 80 is similarly useful for detaching and removing the interior core 40 from the exterior housing 20 of the putting cup 10. Tool 80 comprises a transverse handle 82, an elongate shaft 84, an annular stop 86 that extends outward radially from the shaft 84, and at least one prong 88 that likewise extends outward radially from the shaft 84. The break lines in FIG. 5 illustrate that an upper portion of the shaft 84 has a length sufficient for an individual to be positioned at a comfortable height above the putting cup 10 on the putting surface PS of the putting green PG. Furthermore, the upper portion of the shaft 84 has a larger radial diameter than a lower portion of the shaft 84 to provide sufficient strength against bending along the length of the upper portion of the shaft 84. The stop 86 is disposed between the upper portion and the lower portion of the shaft 84 at a position suitable to engage the upper surface 60 of the cover 44 of the interior core 40 so that the shaft 84 of the tool 80 cannot be extended into the putting hole PH beyond the lower end cap 26 of the exterior housing 20 of the putting cup 10. Each prong 88 of the tool 80 extends outward radially from the shaft 84 sufficiently to engage within a corresponding recess 62 provided in the cover 44 of the interior core 40 of the putting cup 10.

Figure 6:
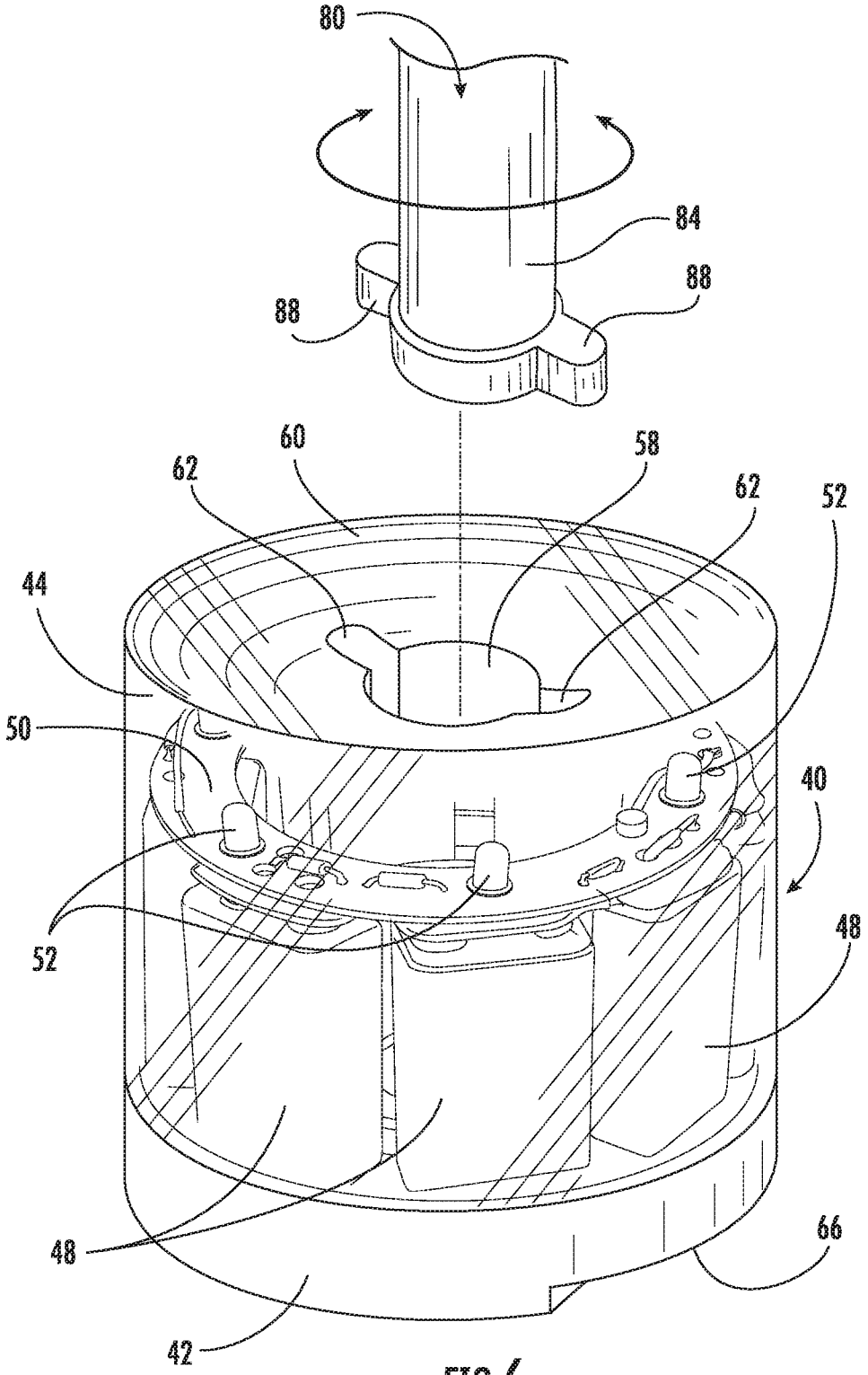
FIG. 6 is an environmental perspective view illustrating use of the tool of FIG. 5 to insert the interior core of the putting cup system into the exterior housing and to removably attach the interior core to the exterior housing of the putting cup system of FIG. 1.

FIG. 6 is an environmental perspective view illustrating use of the tool 80 of FIG. 5 to insert and attach the interior core 40 to the exterior housing 20 of the putting cup system 10 of FIG. 1. In the embodiment shown in FIG. 6, the two radially extending prongs 88 of the tool 80 are inserted into the two corresponding radially extending recesses 62 formed in the top surface 60 of the cover 44 of the core 40. The tool 80 is lowered until the stop 86 abuts the top surface 60 of the cover 44. The lower end of the shaft 84 may have a slight interference fit with the opening 58 of the cover 44 and/or the prongs 88 may have a slight interference fit within the recesses 62 of the cover 44 so that the interior core 40 remains loosely attached to the tool 80. Alternatively, the cover 44 may contain one or more magnets within the opening 58 and/or the recesses 62, and the lower end of the shaft 84 and/or the prongs 88 of the tool 80 may comprise a ferromagnetic material so that the interior core 40 remains magnetically attracted to the tool 80. Preferably, however, the lower end of each vertical recess 62 terminates in a horizontal slot (not shown) that extends circumferentially in both directions. In this manner, the prongs 88 of the tool 80 can first be lowered into the vertical recesses 62 of the cover 44, and the tool 80 can then be rotated about the shaft 84 using the handle 82 so that the interior core 40 is captured by the prongs 88 of the tool 80 within the horizontal slots of the recesses 62 of the cover 44.

Regardless, with the interior core 40 loosely attached to, attracted to, or captured by the tool 80, the core 40 can be lowered into the sleeve 22 of the exterior housing 20 until the base 42 of the core 40 contacts the lower end cap 26 of the housing 20. The tool 80 and the interior core 40 can then be rotated about the shaft 84 of the tool 80 using the handle 82 to engage the internally threaded cylindrical receiver 64 of the base 42 of the core 40 with the externally threaded annular receiver 34 of the end cap 26 of the housing 20. Preferably, the annular receiver 34 and the cylindrical receiver 64 are reverse threaded such that the tool 80 and the core 40 are rotated in the counterclockwise direction to attach the interior core 40 to the exterior housing 20 of the putting cup 10 as an anti-tampering measure. The interior core 40 may be detached from the exterior housing 20 and removed by first inserting the prongs 88 of the tool 80 into the vertical recesses 62 and rotating the tool 80 about shaft 84 so that the prongs 88 are within the horizontal slot of the recesses 62, and then continuing to rotate the tool 80 in the clockwise direction until the internally threaded cylindrical receiver 64 of the base 42 of the core 40 is no longer engaged with the externally threaded annular receiver 34 of the lower end cap 26 of the housing 20. The tool 80 is next lifted upward to remove the interior core 40 from within the sleeve 22 of the exterior housing 20.

Figure 7:
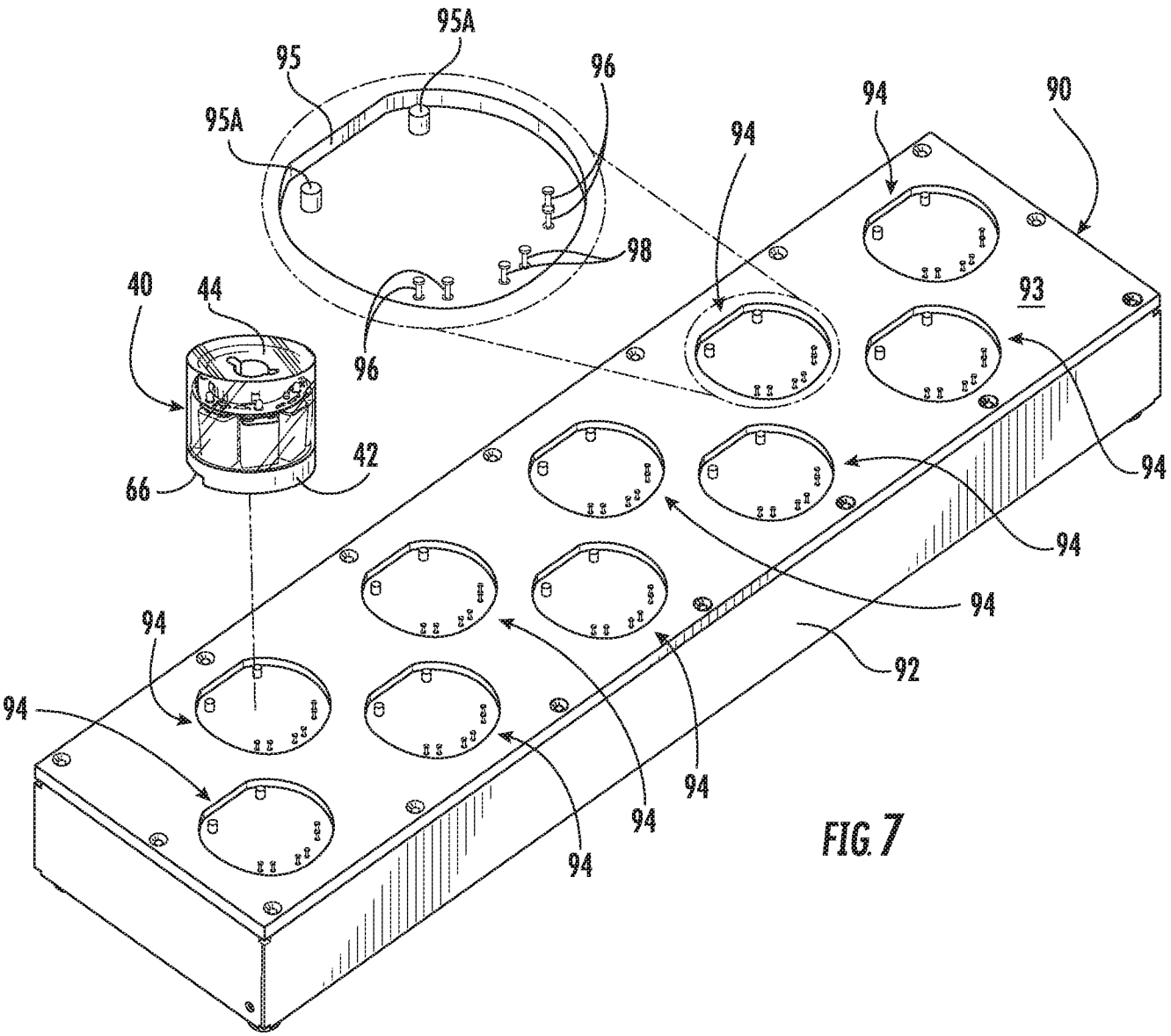
FIG. 7 is an environmental perspective view of an exemplary embodiment of a multi-position charging station for use with the putting cup system of FIG. 1.

FIG. 7 is an environmental perspective view of a multi-station charger, indicated generally by reference character 90, for use with the putting cup system 10 of FIG. 1. The charger 90 comprises a generally box-shaped housing 92, and a plurality of charge stations 94 disposed on a top surface 93 of the housing 92. The charge stations 94 are identical in form and function, and each charge station 94 is configured to receive an interior core 40 of the putting cup system 10 for initially charging or re-charging batteries 48 disposed within the core 40. In the embodiment shown in FIG. 7, the multi-station charger 90 comprises 10 separate charge stations 94 for simultaneously charging up to 10 interior cores 40. The 10 charge stations 94 can therefore simultaneously charge the 10 interior cores 40 utilized for 2 holes (5 cores 40 each) of the HiLo putting sport and game previously described. In one embodiment, the base 42 of the interior core 40 has an L-shaped lip 66 at an outer circumferential partial periphery of the base 42. The charge station 94 has a corresponding flat 95 formed along a portion of an outer periphery of the charge station 94. In this manner, the interior core 40 can be properly aligned with the charge station 94 for charging the batteries 48 disposed within the core 40, as will be described hereafter. Alternatively, or in addition, the charge station 94 may have one or more locating pins 95A that cooperate with corresponding recesses 66A provided on an underside of the base 42.

The charger 90 may comprise a multi-port power strip (not shown) disposed within the housing 92 and a dedicated charging adapter (not shown) for each of the charge stations 94. In this manner, the charger 90 can be electrically connected to a power outlet by a single power cord (not shown) extending from the power strip. In one embodiment, each charging adapter may comprise a HiTech IC29V-RLI Twin Bank Smart Charger commercially available from GN Batteries & Electronics, Inc. of Walnut, Calif. USA that is modified to electrically couple the charging terminals of the charging adapter to the charge station 94. Specifically, each "bank" of each charging adapter is electrically coupled to a pair (positive and negative or ground) of charging contacts 96 provided on the charge station 94. Each pair of charging contacts 96 is electrically connected to the charging contacts 68 (FIG. 4) provided on the interior core 40 for 4 of the batteries 48 disposed within the core 40. Thus, each charge station 94 is operable to charge up to 8 batteries 48 disposed within a single interior core 40 of the putting cup system 10. The charge station 94 may further comprise a pair (positive and negative or ground) of power terminals 98 that may power, for example, a temperature sensor and interrupt circuit that prevents the charge station 94 from continuing to charge the batteries 48 in the event the temperature exceeds a predetermined maximum operating temperature. In another embodiment, the power terminals 98 may power an indicator circuit including indicators, for example, one or more LEDs, that illuminate, blink and/or change color to indicate that the batteries 48 of a core 40 disposed on the charge station 94 are being charged or have completed charging. Power terminals 98 may also be shorted to ground through contacts 70 (FIG. 4) provided on the interior core 40 in order to interrupt electrical power from the batteries 48 to the LEDs 52 when the interior core 40 is not in use, for example, while the core 40 is being stored to replace a core 40 in use with the putting cup system 10.

Figure 8:
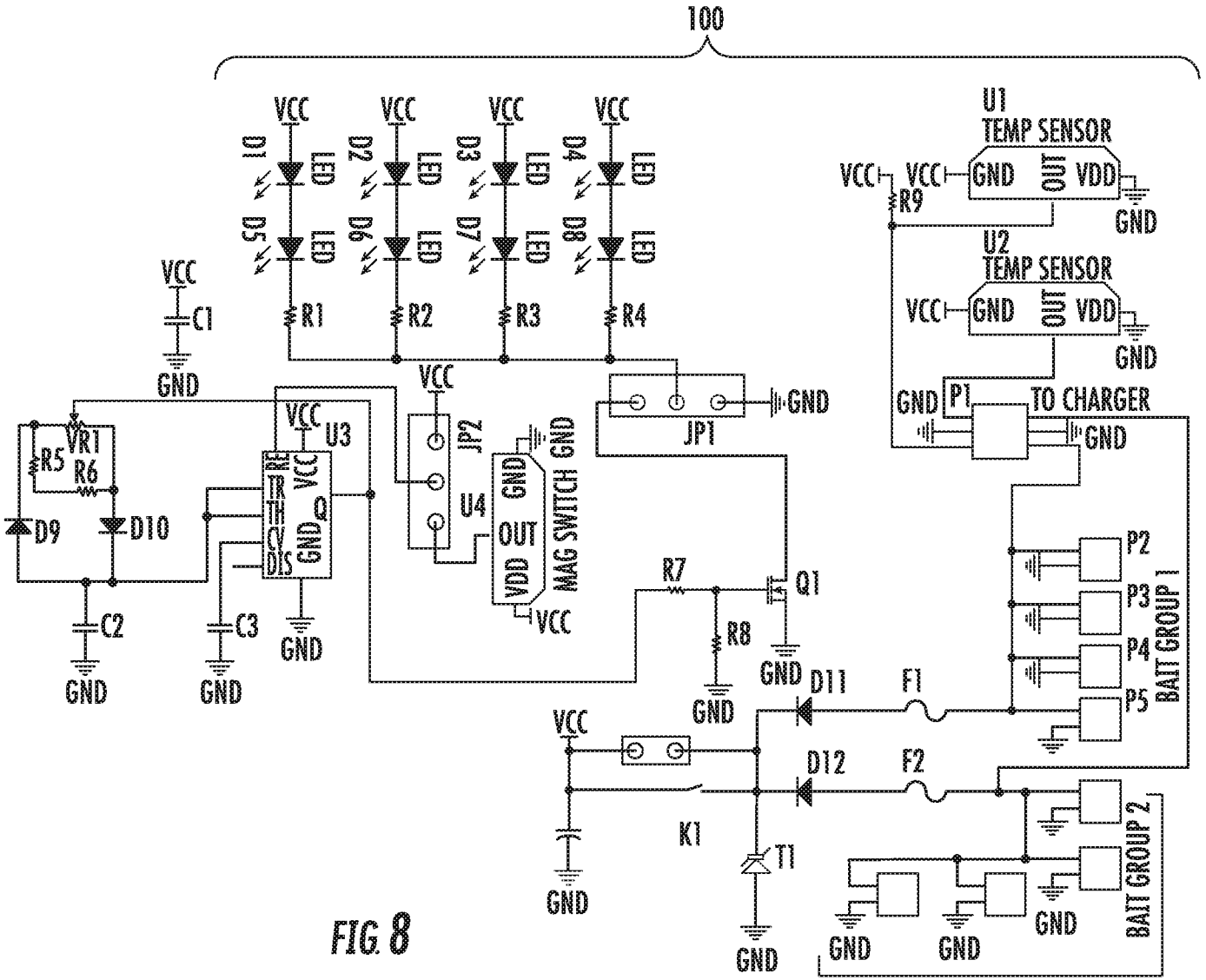
FIG. 8 is a schematic of an exemplary embodiment of a wiring diagram for electrically connecting the electronic components of the interior core of the putting cup system of FIG. 1.

FIG. 8 is a schematic of an exemplary embodiment of a wiring diagram, indicated generally by reference character 100, for electrically connecting the electronic components of the interior core 40 of the putting cup system 10 of FIG. 1. The wiring diagram 100 illustrates that the batteries 48 disposed within the core 40 are electrically connected to the LEDs 52 through the PCB 50 of the interior core 40. Likewise, the batteries 48 are electrically connected to the charging contacts 96 of the charger 90 through the charging contacts 68 on the interior core 40 while the interior core 40 is disposed on a charge station 94 of the charger 90. In an advantageous embodiment, the electronic components of the interior core 40 may further comprise a common LED dimmer circuit, such as a LM555 LED dimmer circuit chip commercially available from Texas Instruments Incorporated of Dallas, Tex. USA, that is soldered onto the PCB 50. An LED dimmer circuit has been found to significantly increase, and at least double, the battery life of the batteries 48 by repeatedly momentarily interrupting power to the LEDs 52 so that the LEDs 52 imperceptibly blink up to 50,000 times per minute, as described hereinabove. Increasing the battery life of the batteries 48 allows the LEDs 52 of the interior core 40 to remain illuminated continuously for up to 10 days without an appreciable loss of intensity (brightness). Alternatively, a non-contact switch, such as a magnetic relay switch or a wireless relay switch, may be disposed within the interior core 40 for powering and not powering the LEDs 52. If desired, the base 42 of the core 40 may be provided with a contact switch that is activated to power the LEDs 52 only when the core 40 is inserted into and attached to the exterior housing 20.

The removable, replaceable and rechargeable interior core 40 provides numerous advantages for the illuminated putting cup system 10. For example, the removable core 40 allows the relatively expensive electronic components, including the batteries 48, the PCB 50 and the LEDs 52 to be separated from the remainder of the putting cup 10 without requiring removal of the exterior housing 20 from a putting hole PH formed in a putting surface PS of a putting green PG. Consequently, the interior core 40 can be easily and readily removed for the purpose of recharging, replacing and/or repairing the core 40 without potentially damaging the putting hole PH or the putting surface PS of the putting green PG. For example, the removable interior core 40 may detached and removed from the exterior housing 20 of the putting cup system 10 and transported to the charger 90 for rapidly recharging the batteries 48 disposed within the core 40. Alternatively, the removable interior core 40 may be immediately replaced with a like replacement core 40 so that the putting hole PH on the putting green PG remains available to be used. Alternatively, the removable interior core 40 allows the electronic components (e.g., PCB 50) contained within the core 40 to be repaired or replaced.

In an advantageous embodiment, the PCB 50 of the interior core 40 may comprise wireless communication capability for controlling operation of the LEDs 52 of the putting cup system 10 from a remote location. By way of example and not limitation, the PCB 50 may be controlled wirelessly to cause the LEDs 52 to turn off and on, to blink, and/or to change color. Furthermore, the PCB 50 may be wirelessly controlled to cause an audible sound to be activated, for example when a putting ball PB enters the putting cup 10. Computer chips may be added to the PCB 50 to provide further functionality, including condition, reliability and operation data reporting to an on-site management office or to a remote control center.

Regardless of the foregoing detailed description of exemplary embodiments of the invention, the optimum configuration of the putting cup system 10, the means for operating the putting cup system 10, the manner of using the putting cup system 10 and/or the steps of associated methods, as well as reasonable equivalents thereof, are deemed to be readily apparent and understood by those skilled in the art. Accordingly, equivalent relationships to those shown in the accompanying drawing figures and described in the written description are intended to be encompassed by the broadest reasonable interpretation and construction of the appended claims. Thus, the foregoing detailed description of exemplary embodiments is considered merely illustrative of the general concept and principles of the present invention(s). Furthermore, as numerous modifications and changes will readily occur to those skilled in the art, the exemplary embodiments are not intended to limit the invention to the specific configuration, construction, materials, manner of use and operation shown and described herein. Instead, all reasonably predictable and suitable equivalents and obvious modifications to the invention should be construed as falling within the scope of the invention as defined by the appended claims given their broadest reasonable interpretation and construction in light of the accompanying written description and drawing figures.

That which is claimed is:

1. A putting cup system for putting sports and games, comprising:

an exterior housing configured to be disposed within a putting hole on a putting green;

an interior core configured to be inserted into and attached to the exterior housing, at least a portion of the interior core being at least partially translucent, the interior core defining an interior compartment configured for housing electronic components operable for illuminating the interior core;

wherein the interior core and the exterior housing are configured to be attached and detached while the exterior housing is disposed within the putting hole on the putting green.

2. The putting cup system according to claim 1, wherein the interior core is configured to be detached from and removed from the exterior housing and replaced with a replacement interior core while the exterior housing remains disposed within the putting hole on the putting green.

3. The putting cup system according to claim 1, wherein the interior core is configured to be detached from and removed from the exterior housing, recharged and subsequently re-inserted into and re-attached to the exterior housing while the exterior housing remains disposed within the putting hole on the putting green.

4. The putting cup system according to claim 1, wherein the electronic components housed within the interior core comprise at least one battery electrically coupled to a printed circuit board (PCB) and at least one light-emitting diode (LED) electrically coupled to the PCB.

5. The putting cup system according to claim 4, wherein the at least one LED emits a predetermined color.

6. The putting cup system according to claim 5, wherein the exterior housing comprises a sleeve and an upper ring, and wherein an inner surface of at least one of the sleeve and the upper ring is provided with the predetermined color of the at least one LED.

7. The putting cup system according to claim 4, wherein the electronic components housed within the interior core further comprise a dimmer circuit operable for periodically interrupting electrical power to the at least one LED to extend the battery life of the at least one battery.

8. The putting cup system according to claim 4, wherein the interior core comprises a base and a cover disposed on the base, and wherein the at least one battery is positioned on an upper surface of the base medially between the base and the PCB, and wherein the at least one LED is positioned medially between the PCB and an upper surface of the cover.

9. The putting cup system according to claim 1, wherein the interior core comprises a base having a central opening and a cover disposed on the base and having a central opening, and wherein the central opening of the cover is aligned and in communication with the central opening of the base to define a drain.

10. The putting cup system according to claim 1, wherein the exterior housing comprises a lower end cap having a receiver and the interior core comprises a base having a receiver, and wherein the receiver of the base and the receiver of the lower end cap engage to attach the interior core to the exterior housing.

11. The putting cup system according to claim 1, wherein the electronic components comprise a plurality of rechargeable batteries for providing electrical power to a printed circuit board (PCB), and a plurality of light-emitting diodes (LEDs) electrically coupled to the PCB.

12. The putting cup according to claim 11, wherein the PCB is ring-shaped and the LEDs are spaced circumferentially on an upper surface of the ring-shaped PCB.

13. The putting cup system according to claim 1, wherein the exterior housing comprises a cylindrical sleeve and a cylindrical upper ring, and wherein the upper ring is removably disposed on the sleeve.

14. The putting cup system according to claim 1, wherein the interior core has a central opening configured for receiving a custom tool operable for attaching the interior core to the exterior housing and for detaching the interior core from the exterior housing while the exterior housing is disposed within the putting hole on the putting green.

15. The putting cup system according to claim 14, wherein the custom tool comprises a handle, an elongated shaft and at least one prong configured for cooperating with at least one recess formed in the interior core.

16. A putting cup, comprising:

an exterior housing comprising a sleeve and a lower end cap secured to the sleeve; and an interior core comprising a base and a cover disposed on the base, the interior core defining an interior compartment for housing electronic components;

wherein the lower end cap of the exterior housing has a receiver and the base of the interior core has a corresponding receiver that engages the receiver of the lower end cap to removably attach the interior core to the exterior housing while the exterior housing is disposed within the putting hole of the putting green.

17. The putting cup according to claim 16, wherein the electronic components housed within the interior compartment are operable for illuminating the interior core.

18. The putting cup according to claim 16, wherein the electronic components housed within the interior compartment comprise at least one battery electrically coupled to at least one light emitting diode (LED).

19. The putting cup according to claim 16, wherein the electronic components housed within the interior compartment further comprise a dimmer circuit operable for periodically interrupting electrical power from the at least one battery to the at least one LED to extend the battery life of the at least one battery.

20. The putting cup according to claim 16, wherein the interior core has a central opening and at least recess configured for receiving a custom tool having at least one prong that cooperates with the at least one recess to attach the interior core to the exterior housing and to detach the interior core from the exterior housing while the exterior housing is disposed within the putting hole on the putting green.

* * * * *